US006762596B2

(12) United States Patent
Yokogawa et al.

(10) Patent No.: US 6,762,596 B2
(45) Date of Patent: Jul. 13, 2004

(54) CONSTANT VOLTAGE CIRCUIT AND INFRARED REMOTE CONTROL RECEIVER USING THE SAME

(75) Inventors: Naruichi Yokogawa, Kashihara (JP); Takahiro Inoue, Kitakatsuragi-gun (JP)

(73) Assignee: Sharp Kabushiki Kaisha, Osaka (JP)

( * ) Notice: Subject to any disclaimer, the term of this patent is extended or adjusted under 35 U.S.C. 154(b) by 106 days.

(21) Appl. No.: 10/241,519

(22) Filed: Sep. 12, 2002

(65) Prior Publication Data

US 2003/0062883 A1 Apr. 3, 2003

(30) Foreign Application Priority Data

Sep. 12, 2001 (JP) ..... P2001-277033

(51) Int. Cl.[7] ..... G05F 3/16
(52) U.S. Cl. ..... 323/316; 330/260
(58) Field of Search ..... 323/313, 314, 323/315, 316, 280; 327/108, 109; 330/260, 274

(56) References Cited

U.S. PATENT DOCUMENTS 5,563,502 A 10/1996 Akioka et al.
6,515,461 B2 * 2/2003 Akiyama et al. ..... 323/313
6,559,692 B2 * 5/2003 Kimball et al. ..... 327/109

FOREIGN PATENT DOCUMENTS

JP 5-233084 A 9/1993

* cited by examiner

*Primary Examiner*—Jessica Han
(74) *Attorney, Agent, or Firm*—Birch, Stewart, Kolasch & Birch, LLP

(57) ABSTRACT

A direct current input power supply voltage Vcc is outputted to the load side via a PNP type transistor having a small Vce. A base thereof is driven by a base current from which noise is removed in a power source noise removing circuit. An input to the noise removing circuit is produced by shifting a level from the Vcc side by a direct current level shift circuit. Since an output voltage Vs varies with reference to Vcc and a voltage drop is relatively small owing to the transistor, an operation voltage on the load side can be ensured. The noise removing circuit is constituted by a gm amplifier. In order to increase a noise removing rate at low frequencies, by setting gm of a time constant C/gm to a small value, it is possible to set a capacity to a value which allows integration.

11 Claims, 12 Drawing Sheets

CONSTANT VOLTAGE CIRCUIT AND INFRARED REMOTE CONTROL RECEIVER USING THE SAME

BACKGROUND OF THE INVENTION

1. Field of the Invention

The present invention relates to a constant voltage circuit which is preferably used in an infrared remote control receiver, a low-frequency highly sensitive sensor circuit and the like, and to an infrared remote control receiver equipped with the same, and especially relates to countermeasures against power source noise thereof.

2. Description of the Related Art

FIG. 9 is a block diagram which entirely shows an example of a reception system of an infrared remote control receiver 1, and FIGS. 10A to 10D are waveform diagrams of individual portions thereof. This receiver 1 converts infrared transmission code signals to photocurrent signals Iin shown in FIG. 10A in an external photodiode 2 to input the signals into a reception chip 3 which is configured as an integrated circuit, and outputs output signals OUT shown in FIG. 10D demodulated in the reception chip 3 to a microcomputer which controls electronics and the like. The infrared signals are ASK signals which are modulated by a predetermined carrier from 30 kHz to 60 kHz approximately.

Within the reception chip 3, the photocurrent signals Iin shown in FIG. 10A are amplified sequentially in a first amplifier (HA) 4, a second amplifier (2nd AMP) 5 and a third amplifier (3rd AMP) 6, and a carrier component as shown by a reference numeral α1 in FIG. 10B is taken out in a band pass filter (BPF) 7 which is matched with the frequency of the carrier. Then, the carrier component is detected at a carrier detection level Det denoted by a reference numeral α2 in a detector circuit 8 of the following stage, a time when the carrier exists is integrated in an integration circuit 9 as shown by a reference numeral α11 in FIG. 10C, and an integration output Int obtained thereby is compared with a predetermined discrimination level denoted by a reference numeral α12 in a hysteresis comparator 10, whereby the presence or absence of the carrier is recognized, and the signals are digitally outputted as output signals OUT shown in FIG. 10D.

A low pass filter 11 is placed on the output side of the first amplifier 4, by which a direct current level by a fluorescent lamp and sunlight is detected, and in the second amplifier 5 of the following stage, the part of the direct current level is eliminated from a direct output of the first amplifier 4 and the output is amplified, whereby the influence of noise of the fluorescent lamp, sunlight and so on is removed at a certain level. Moreover, a ABCC (Auto Bias Current Control) circuit 12 is placed with reference to the first amplifier 4, and by this ABCC circuit 12, a direct current bias of the first amplifier 4 is controlled in response to an output of the low pass filter 11.

It has been mainstream up to now that a power supply voltage of the infrared remote control receiver 1 configured in the above manner and a highly sensitive sensor circuit is a 5 V system. However, in recent years, a power supply voltage of a peripheral LSI has been decreased to, for example, 3 V, and power consumption thereof has been decreased, and also regarding the infrared remote control receiver 1 and a highly sensitive sensor circuit, voltage decrease has been strongly desired. On the other hand, a request of a device supplier for a power supply voltage has a broad range. For example, a guarantee of a minimum operating voltage of 3.3 V±0.3 V is required in one system, and 2.4 V or 1.8 V is required in another system using a battery. In this manner, regarding voltage decrease, a response to a broad range of power supply voltage is often required in one device.

With reference to such a response as described above, power source noise is one of the design problems to take countermeasures. The power source noise enters from a power source in most cases and enters from a load side in some cases, thereby causing jitters in a power supply voltage. In the infrared remote control receiver 1 and a highly sensitive sensor circuit, an amplifier (denoted by reference numerals 4, 5 in FIG. 9) amplifies infrared signals and sensor signals at a very high gain, and therefore the amplifier is very apt to be affected by power source noise. In a case where power source noise influences the operation of the amplifier in the circuit, it is amplified to cause malfunction throughout.

Although, for this reason, it has been historically recommended to insert and mount a noise filter in a power supply line of a sensor circuit and the like, states of power source noise are different depending on used sets, and trouble is often caused. Furthermore, because of downsizing of a package in recent years, it becomes difficult to mount such a power source filter resistor and a capacitor in a package, so that there is no other choice to build a constant voltage circuit for countermeasures against power source noise in an integrated circuit.

FIG. 11 is a view for describing countermeasures against power source noise of a typical prior art. In this prior art, by inserting a constant voltage circuit 22 in a power supply bias of an amplifier 21, power source noise is decreased. The constant voltage circuit 22 is a so-called three-terminal regulator. A direct current output voltage Vs from the constant voltage circuit 22 is fixed, and by preventing variation of a power supply voltage Vcc, that is, preventing the power source noise from transmitting to the output voltage Vs, the influence of the power source noise on the amplifier 21 is prevented or decreased.

Here, in a case where the voltage range of the power supply voltage Vcc required to be responded is broad as described before, it is necessary to set the value of the output voltage Vs of the constant voltage circuit 22 in relation to the minimum voltage that guarantees the operation. As a result, the operation range of the amplifier 21 is also restricted by the voltage. In other words, even in a case where the amplifier is used in a state that the power supply voltage Vcc is not the minimum voltage that guarantees the operation, for example, even in a case where the amplifier is used at 3.3 V while the minimum operation voltage thereof is 2.4 V, the output voltage Vs of the constant voltage circuit 22 remains set to less than 2.4 V, so that the maximum output amplitude from the amplifier 21 does not become 3.3 V but remains 2.4 V.

As a general example of countermeasures against such a problem, a configuration shown in FIG. 12 which is another prior art may be cited. In this prior art, the power supply voltage Vcc is supplied to the amplifier 21 via a NPN transistor q, and the power supply voltage Vcc is supplied to a base of the transistor q via a low pass filter constituted by a resistor r and a capacitor c. Therefore, power source noise is decreased in the low pass filter, and a current capacity is ensured in the transistor q to become a bias voltage (Vs) of the amplifier 21, whereby the countermeasures against the power source noise are taken. Since the bias voltage (Vs) varies in conjunction with the power supply voltage Vcc, the operation range of the amplifier 21 can be enlarged when the power supply voltage Vcc is high.

However, according to the prior art described above, there is a problem that, since the infrared remote control receiver 1 and a sensor circuit that handle low-frequency signals of tens of kHz or so require that a time constant of RC is set to a large value, it is impossible to achieve integration with ease. For example, a capacity value which allows integration is normally 100 pF or less. Furthermore, a practical capacity value for decreasing the influence on a chip area is 20 pF or so. In order to achieve a capability of removing power source noise to some extent while using this capacity value, a large time constant by an enormously large resistance component is needed. For example, in a case where it is required to set a power source noise removing rate PSRR at 40 kHz to −40 dB (1/100), assuming that c=20 pF, the resistance value R of the resistor r is obtained by expressions shown below:

$$PSRR = \frac{1}{\sqrt{1 + (2\pi fCR)^2}} \tag{1}$$

Therefore, $$R = \sqrt{\frac{1}{(2\pi fC)^2}\left[\frac{1}{PSRR^2} - 1\right]} \approx 19.9M\Omega \tag{2}$$

Accordingly, it is difficult to place a resistance value of this order as it is in the integrated circuit.

Further, according to the prior art described above, there is also a problem that, since an operating voltage (VBE) of the transistor q is needed, a value of Vα which is difference between Vcc and Vs becomes large and an operating voltage of the amplifier 21 does not become so large.

SUMMARY OF THE INVENTION

An object of the present invention is to provide a constant voltage circuit which has a configuration allowing integration and which can ensure an operating voltage of a load side in conjunction with a power supply voltage, and provide an infrared remote control receiver using the same.

The invention provides a constant voltage circuit which removes power source noise by outputting a direct current constant voltage responsive to a direct current input power supply voltage, the constant voltage circuit comprising:

- a direct current level shift circuit for effecting a shift from the input power supply voltage by a predetermined direct current voltage level;
- a power source noise removing circuit including a transconductance amplifier, for removing the power source noise from an output of the direct current level shift circuit; and
- a PNP type transistor interposed in series with a power supply line between input and output terminals, a base of the PNP type transistor being driven by an output from the power source noise removing circuit.

According to the invention, a direct current input power supply voltage is outputted to the load side via the PNP type transistor in which difference between emitter and collector voltages, that is, input and output voltages is small, and the base thereof is driven by a base current from which power source noise is removed in the power source noise removing circuit. Then, an input to the power source noise removing circuit is produced by shifting a level from the side of the input power supply voltage in the direct current level shift circuit.

Therefore, an output voltage varies in response to a direct current input power supply voltage, and a voltage drop from the input current voltage is relatively low owing to the PNP type transistor, with the result that an operation voltage on the load side can be ensured. Moreover, since the power source noise removing circuit includes the transconductance amplifier, it is possible by setting transconductance gm of a time constant C/gm to a small value to obtain a capacity C of a value which allows integration, in order to increase a power source noise removing rate at low frequencies.

Furthermore, in the invention it is preferable that a level shift amount in the direct current level shift circuit is set to around a collector-emitter saturation voltage of the PNP type transistor.

According to the invention, an output voltage can be maximized to direct current variation of the power supply voltage, so that it is possible to set a direct current operation range of a load side circuit to a maximum value while removing power source noise sufficiently.

Still further, in the invention it is preferable that:

- an input circuit of the transconductance amplifier constituting the power source noise removing circuit is provided with first to fourth transistors QN1 to QN4 of a same conducting type and a resistor R1;
- bases or gates of the first and second transistors QN1, QN2 are connected to each other to become a first input terminal of the transconductance amplifier, and emitters or sources of the first and second transistors QN1, QN2 are connected to a first constant current source F1 in common;
- bases or gates of the third and fourth transistors QN3, QN4 are connected to each other to become a second input terminal of the transconductance amplifier, and emitters or sources of the third and fourth transistors QN3, QN4 are connected to a second constant current source F2 in common;
- the emitters or sources of the first and second transistors QN1, QN2 are connected to the emitters or sources of the third and fourth transistors QN3, QN4 via the resistor R1; and
- collectors or drains of the first and fourth transistors QN1, QN4 are connected to a power source terminal.

According to the invention, even in the case of setting a capacity of the resistor R1 to a value which allows integration into an integrated circuit, it is possible to produce very low transconductance gm and obtain a sufficient noise removing rate.

Still further, in the invention it is preferable that:

- an output circuit of the transconductance amplifier constituting the power source noise removing circuit is provided with fifth and sixth transistors QP5, QN5 of different conducting types from each other;
- a base or gate of the fifth transistor QP5 is connected to a base or gate of the sixth transistor QN5; and
- a capacity C of the transconductance amplifier is charged and discharged by a base or gate current io.

According to the invention, the base or gate current io of the fifth and sixth transistors QP5, QN5 is used to produce sufficiently small transconductance gm, and a low pass filter is implemented, so that even in the case of setting the capacity C to a value which allows integration, it is possible to obtain a large time constant responsive to low frequency signals.

Still further, in the invention it is preferable that:

the output circuit of the transconductance amplifier constituting the power source noise removing circuit is further provided with, in correspondence with the fifth and sixth transistors, seventh and eighth transistors QP6, QN6 of different conducting types from each other;

the fifth transistor QP5 of one conducting type is paired with the sixth transistor QN5 of the other conducting type, and the seventh transistor QP6 of one conducting type is paired with the eighth transistor QN6 of another conducting type;

a base or gate of the seventh transistor QP6 is connected to a base or gate of the eighth transistor QN6, collectors or drains of the fifth and seventh transistors QP5, QP6 are connected to a ground (GND) or a power source in common, a collector or drain of the sixth transistor QN5 is connected to the power source or the GND, an emitter or source of the sixth transistor QNS is connected to a collector or drain of the eighth transistor QN6, and an emitter or source of the eighth transistor QN6 is connected to the GND or the power source; and a differential current is inputted from the input circuit to emitters or sources of the fifth and seventh transistors QP5, QP6.

According to the invention, by forming the input circuit so as to have a differential configuration, it is possible to decrease power source noise affecting the power source noise removing circuit itself, and even when a parasitic photocurrent is generated in a base or gate terminal of the PNP type transistor, the photocurrent is cancelled, and it is possible to prevent transconductance gm from varying.

Still further, in the invention it is preferable that of the fifth to eighth transistors QP5, QN5, QP6, QN6, transistors which use a minute base or gate current io are PNP type transistors QP5, QP6, which transistors QP5, QP6 are formed so as to be of a lateral structure, and with respect to the PNP type transistors QP5, QP6, a parasitic photocurrent compensating circuit is disposed.

According to the invention, it is possible to cancel a parasitic photocurrent which is generated in the case where, of the fifth to eighth transistors QP5, QN5, QP6, QN6, the PNP type transistors QP5, QP6 using a minute base or gate current io are of a lateral structure allowing easy production without using a special process, by the use of the parasitic photocurrent compensating circuit. With this, it is possible to suppress variation of transconductance gm.

Still further, in the invention it is preferable that of the fifth to eighth transistors QP5, QN5, QP6, QN6, transistors which use a minute base or gate current io are PNP type transistors QP5, QP6, which PNP type transistors QP5, QP6 are formed so as to be of a vertical structure.

According to the invention, it is possible to decrease the parasitic photocurrent itself.

Still further, in the invention it is preferable that a voltage is supplied to the collector of at least one of the fifth and seventh transistors QP5, QP6, and collector-emitter voltages of the transistors are set to a substantially equal value.

According to the invention, the imbalance due to Early effect between the fifth and seventh transistors QP5, QP6 can be reduced, and an offset of a direct current voltage can be decreased.

Still further, in the invention it is preferable that an input of a first buffer circuit is connected to the base or gate of at least one of the fifth and seventh transistor QP5, QP6, and an output of the buffer circuit is connected to the collector or drain of the aforementioned transistor.

Still further, in the invention it is preferable that an input of a first buffer circuit is connected to the base or gate of at least one of the fifth and seventh transistors QP5, QP6, a level adjusting circuit which shifts a direct current level is added to an output of the first buffer circuit, an input of a second buffer circuit is connected to an output of the level adjusting circuit, and an output of the second buffer circuit is connected to the collector or drain of at least one of the fifth and seventh transistors QP5, QP6.

According to the invention, collector-emitter voltages of the fifth and seventh transistors QP5, QP6 are set so as to become constant to variation of a power supply voltage, whereby the imbalance due to Early effect of the respective transistors QP5, QP6 can be reduced, and an offset of a direct current voltage can be decreased.

Still further, the invention provides an infrared remote control receiver comprising any one of the constant voltage circuits described above.

According to the invention, the infrared remote control receiver is very apt to be affected by power source noise because an amplifier which is a load circuit handles low-frequency signals and a gain thereof is high, and therefore able to preferably use the constant voltage circuit described above.

BRIEF DESCRIPTION OF THE DRAWINGS

Other and further objects, features, and advantages of the invention will be more explicit from the following detailed description taken with reference to the drawings wherein.

DETAILED DESCRIPTION OF THE PREFERRED EMBODIMENTS

Figure 1:
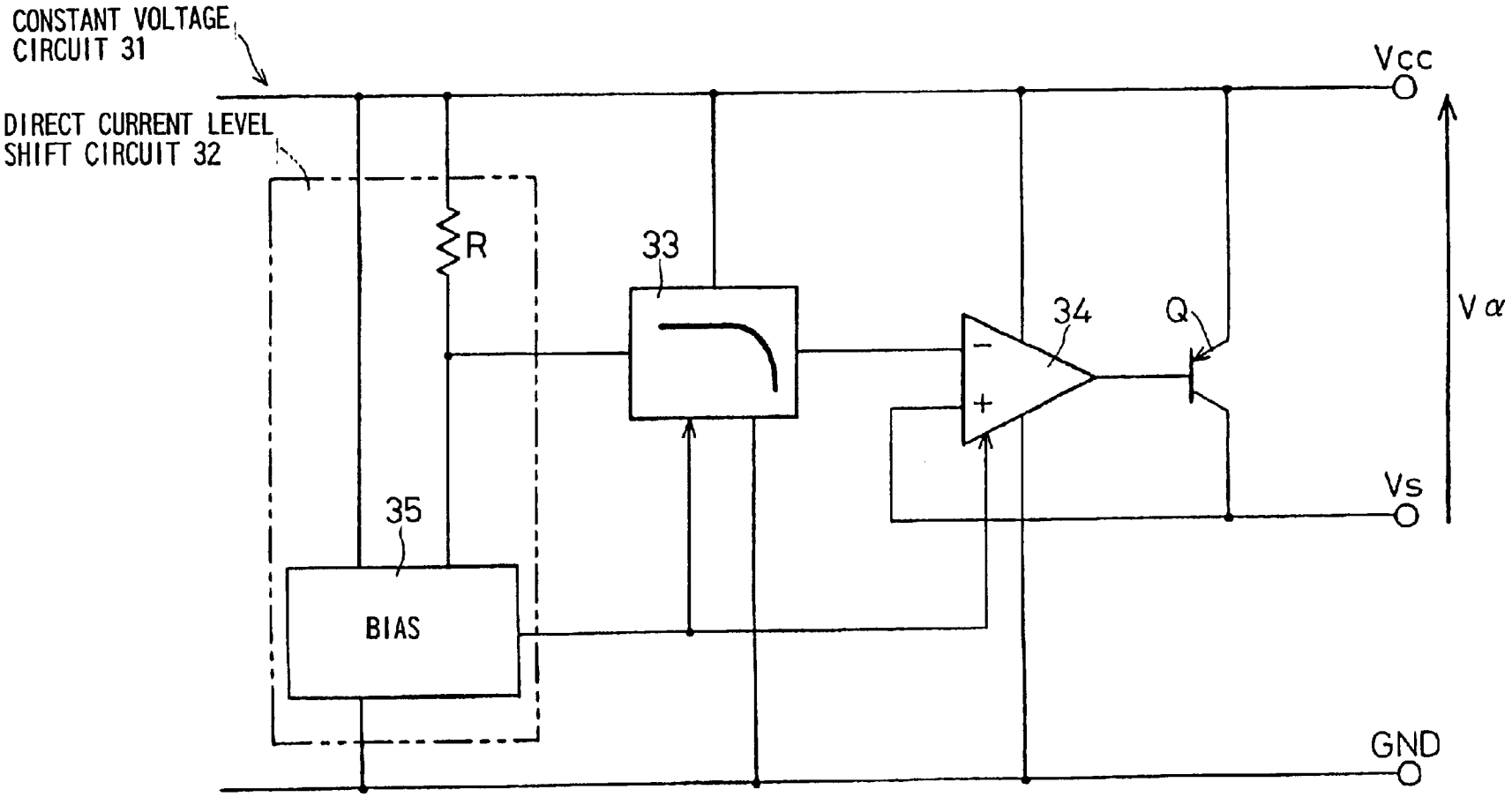
FIG. 1 is a block diagram showing an electrical configuration of a constant voltage circuit of an embodiment of the present invention.

Now referring to the drawings, preferred embodiments of the invention are described below.

An embodiment of the present invention will be explained below based on FIGS. 1 to 6.

FIG. 1 is a block diagram which shows an electrical configuration of a constant voltage circuit 31 of the embodiment of the invention. This constant voltage circuit 31 comprises a direct current level shift circuit 32 which performs a shift from a direct current input power supply voltage Vcc by a predetermined direct current voltage level, a power source noise removing circuit 33 which removes power source noise from an output of the direct current level shift circuit, a differential amplification circuit 34 which compares an output from the power source noise removing circuit 33 with an output voltage Vs to a load side circuit such as amplifiers 4, 5 shown in FIG. 9 and outputs a voltage responsive to the difference, and a PNP type transistor Q whose base is driven by an output from the differential amplification circuit 34 and which is interposed in series with a power source line between input and output terminals. The differential amplification circuit 34 and the transistor Q constitute a voltage follower circuit.

The direct current level shift circuit 32 includes, in concrete, a bias resistor R which steps down the direct current input power supply voltage Vcc and supplies to the power source noise removing circuit 33, and a bias circuit 35 which sets a voltage drop by the bias resistor R to a predetermined direct current voltage level in response to the input power supply voltage Vcc and supplies a bias current to the power source noise removing circuit 33 and the differential amplification circuit 34.

Figure 2:
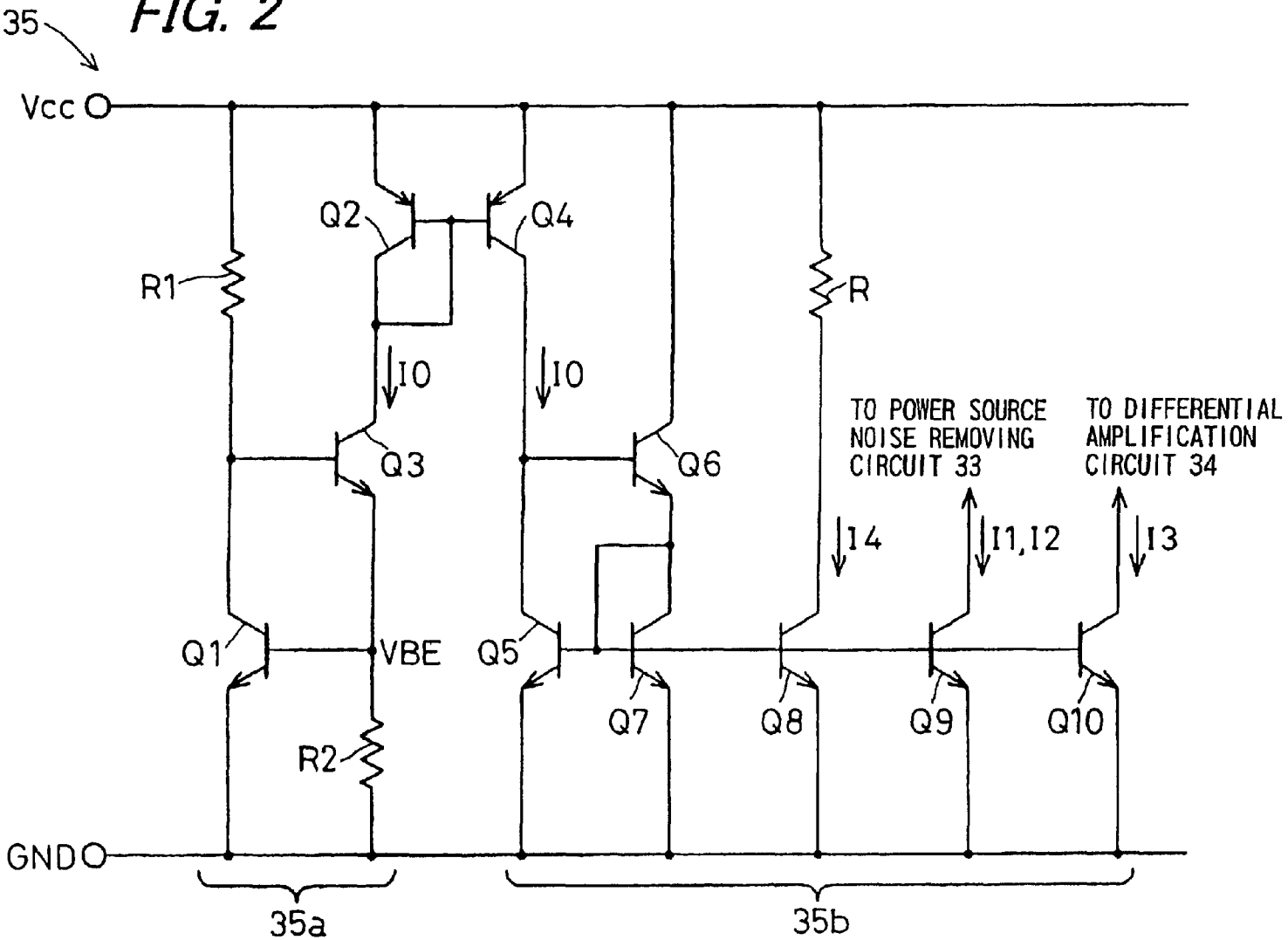
FIG. 2 is an electrical circuit diagram showing an example of a configuration of a bias circuit in the constant voltage circuit shown in FIG. 1.

FIG. 2 is an electrical circuit diagram which shows an example of a configuration of the bias circuit 35. This bias circuit 35 includes, in general, a reference current producing circuit 35*a* which produces a reference current IO, and a bias current producing circuit 35*b* which produces currents I1 to I4 to the respective circuits based on the reference current IO.

The reference current producing circuit 35*a* includes transistors Q1 to Q3 and resistors R1, R2. In the embodiment of the invention, the transistor Q1 is a PNP type transistor, and the transistors Q2, Q3 are NPN type transistors. A series circuit of the resistor R1 and the transistor Q1 and a series circuit of the transistors Q2, Q3 and the resistor R2 are connected between a power supply line of the power supply voltage Vcc and a ground (GND) line. A terminal voltage of the resistor R2 is supplied to a base of the transistor Q1, a base and a collector of the transistor Q2 are connected to each other by diode-connection, and a base of the transistor Q3 is connected to a collector of the transistor Q1. Therefore, the transistor Q1 is biased by the resistor R1, and a current of VBE/R2 of the transistor Q1 flows in a collector of the transistor Q2 to become the reference current I0.

The bias current producing circuit 35b includes transistors Q4 to Q10. In the embodiment of the invention, the transistor Q4 is a PNP type transistor, and the transistors Q5 to Q10 are NPN type transistors. A series circuit of the transistors Q4, Q5 and a series circuit of the transistors Q6, Q7 are connected between the power supply line of the power supply voltage Vcc and the GND line, a base of the transistor Q4 is connected to the base of the transistor Q2 constituting a current mirror circuit together with the transistor Q4, and a collector current of the transistor Q4 becomes the reference current I0. The transistor Q5 constitutes a current mirror circuit together with the transistor Q7, and a base of the transistor Q6 is connected to a collector of the transistor Q5. The transistor Q7 constitutes current mirror circuits together with the respective transistors Q8 to Q10. As a result, from collectors of the transistors Q8 to Q10, currents I4; I1, I2; 13 based on the reference current I0 are supplied as bias currents to the bias resistor R, the power source noise removing circuit 33, and the differential amplification circuit 34, respectively.

Although the power source noise removing circuit 33 is implemented by, for example, a low pass filter, when the frequency and frequency range of power source noise to be removed are restricted, it is better to use a band elimination filter such as a notch filter to increase a removing capability.

With this, a direct current output voltage Vs is kept to be Vcc−level shift voltage (=Vα) at all times, and it is possible to set an operating voltage (Vs) on the load side to a maximum value in response to the power supply voltage Vcc. Further, since the direct current level shift circuit 32 obtains a level shift voltage Vα from a bias current produced in the bias circuit 35 and the bias resistance R, an unrestricted level shift voltage can be produced with ease. The level shift voltage Vα is set to around a collector-emitter saturation voltage of the PNP type transistor Q, for example, 0.2 V. With this, it is possible to set the output voltage Vs to around Vcc −0.2 V in response to direct current variation of the direct current input power supply voltage Vcc, and maximize a bias voltage, so that it is possible to set the operation range of the load side circuit to the maximum, and remove power source noise sufficiently.

Figure 3:
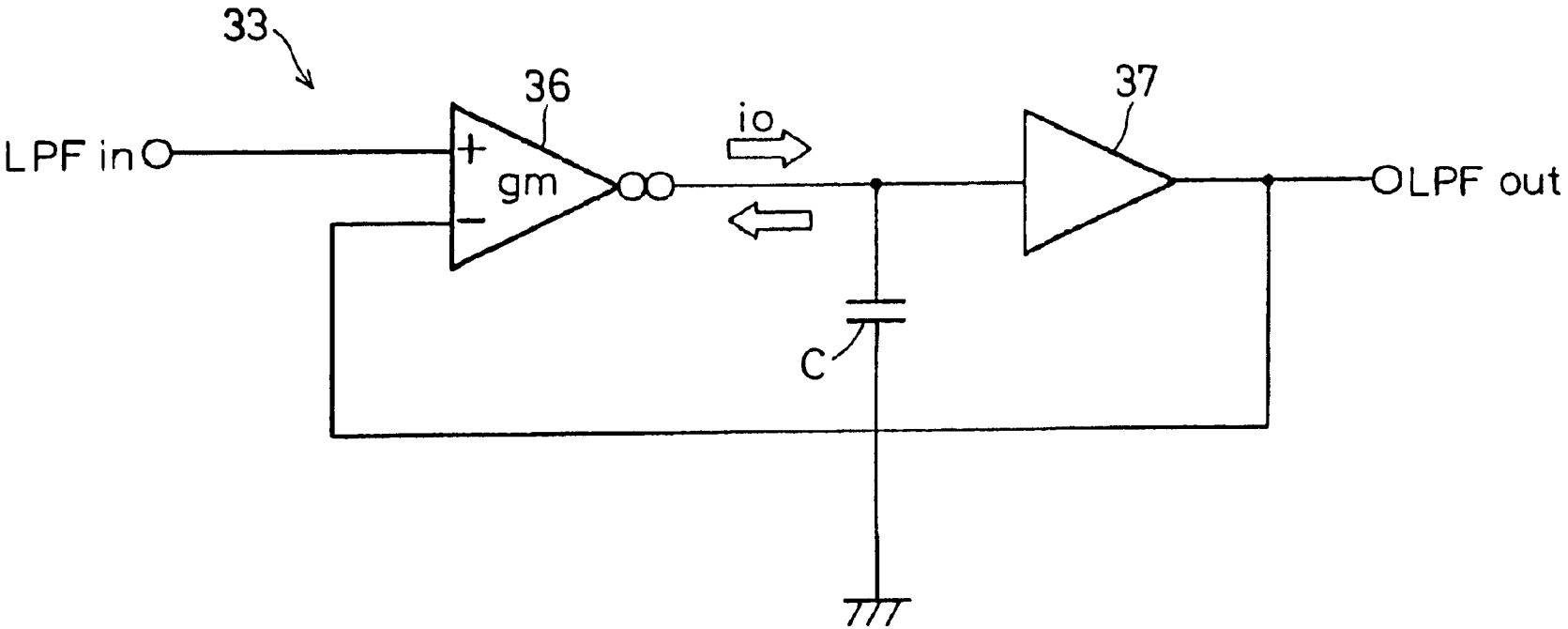
FIG. 3 is a block diagram showing an example of a configuration of a power source noise removing circuit in the constant voltage circuit shown in FIG. 1.

FIG. 3 is a block diagram which shows an example of a configuration of the power source noise removing circuit 33. As described before, this power source noise removing circuit 33 is formed by a low pass filter, and includes a transconductance amplifier 36, an inversion input buffer circuit 37, and a capacitor C. A noninverted input of the transconductance amplifier 36 of a differential configuration becomes an input LPFin of the low pass filter, an output of the transconductance amplifier 36 is connected to an input of the inversion input buffer circuit 37, to a connection point of which one end of the capacitor C is connected, and the other end of the capacitor C is grounded to a GND. An inverted input of the transconductance amplifier 36 is connected to an output of the inversion input buffer circuit 37, a connection point of which becomes an output LPFout of the low pass filter.

By using a low pass filter configured in this manner and setting transconductance gm of the transconductance amplifier 36 to a small value, it is possible to increase a power source noise removing capability with ease. A transfer function $H_{LPF}(S)$ of frequency characteristics of this circuit can be expressed by an expression shown below:

$$H_{LPF}(s) = \frac{1}{1 + s\frac{C}{gm}} \tag{3}$$

Although there is a need to set a time constant C/gm to a large value in order to increase a power source noise removing rate at low frequencies, it is possible to set the time constant to a large value with ease by setting gm to a small value when C is set to a value which allows integration.

Figure 4:
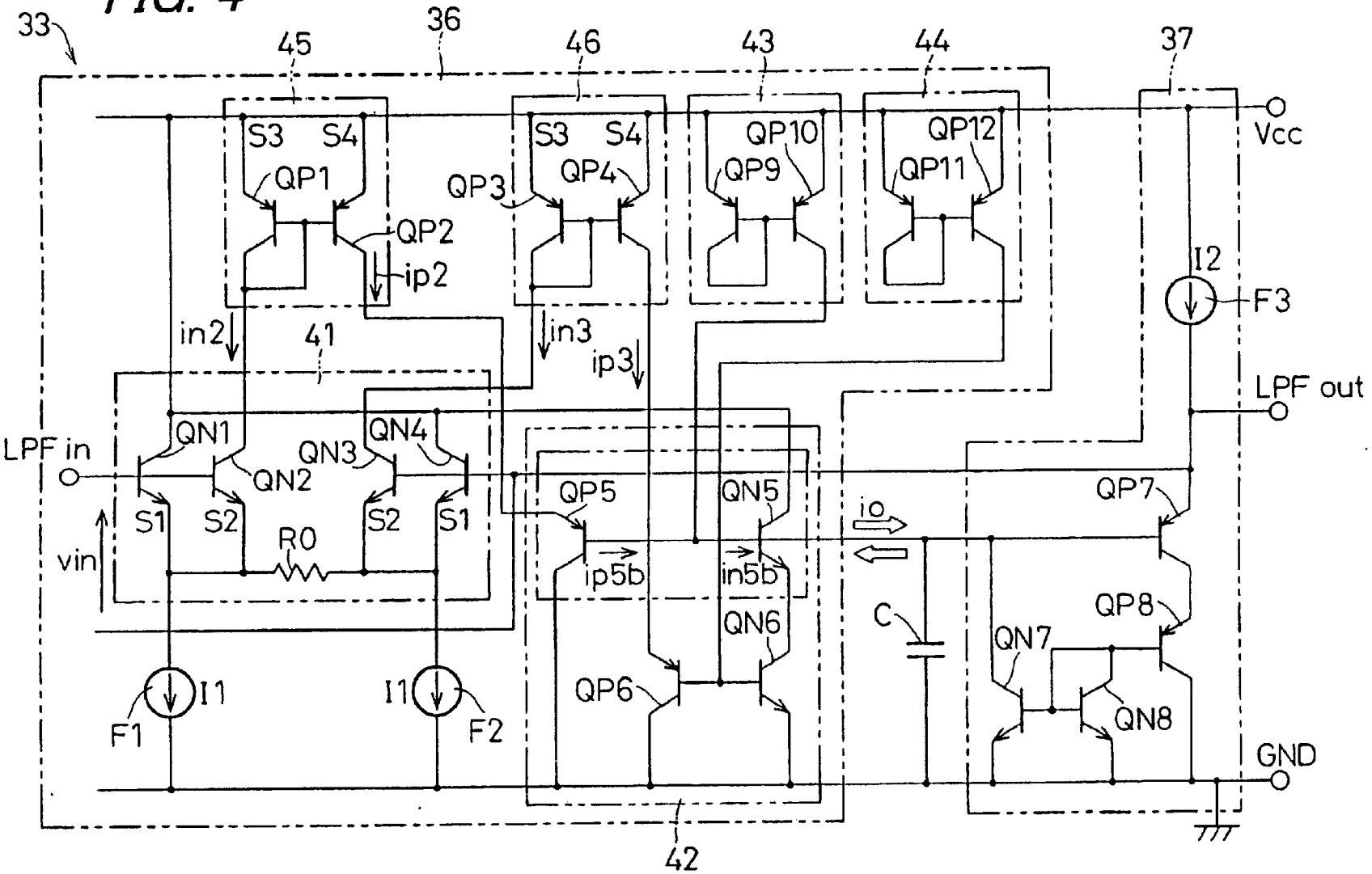
FIG. 4 is an electrical circuit diagram showing a concrete configuration of a transconductance amplifier and a buffer circuit which constitute the power source noise removing circuit.

FIG. 4 is an electrical circuit diagram which shows a concrete configuration of the transconductance amplifier 36 and the inversion input buffer circuit 37. The transconductance amplifier 36 includes, in general, an input circuit 41, an output circuit 42, parasitic photocurrent compensating circuits 43, 44, and current mirror circuits 45, 46. The input circuit 41 and the output circuit 42 are circuits for producing very low transconductance gm. Firstly, these circuits will be explained.

The input circuit 41 is constituted by transistors QN1 to QN4 of the same conducting type and a resistor RO. In the embodiment of the invention, the transistors QN1 to QN4 are NPN type transistors. Bases of the transistors Qn1, QN2 are connected to each other to become a first input terminal of the transconductance amplifier 36. Further, emitters of these transistors QN1, QN2 are connected in common to a constant current source F1 which supplies a current I1. In a like manner, bases of the transistors QN3, QN4 are connected to each other to become a second input terminal of the transconductance amplifier 36. Further, emitters of these transistors QN3, QN4 are connected in common to a constant current source F2 which supplies the current I1. Moreover, the emitters of the transistors QN1, QN2 are connected to the emitters of the transistors QN3, QN4 via the resistor RO, and collectors of the transistors QN1, QN4 are connected to a power supply terminal.

On the other hand, the output circuit 42 has a pair of a transistor QP5 of one conducting type and a transistor QN5 of the other conducting type and a pair of a transistor QP6 of one conducting type and a transistor QN6 of the other conducting type. In the embodiment of the invention, the transistors QP5, QP6 are PNP type transistors, and the transistors QN5, QN6 are NPN type transistors. A base of the transistor QP5 is connected to a base of the transistor QN5, a base of the transistor QP6 is connected to a base of the transistor QN6, collectors of the transistors QP5, QP6 are connected to a GND in common, a collector of the transistor QN5 is connected to a power supply voltage Vcc, an emitter of this transistor QN5 is connected to a collector of the transistor QN6, and an emitter of the transistor QN6 is connected to the GND.

The current mirror circuits 45, 46 are constituted by transistors QP1, QP2; QP3, QP4 of the same conducting type, respectively. In the embodiment of the invention, the transistors QP1 to QP4 are PNP type transistors.

In the one current mirror circuit 45, bases of the transistors QP1, QP2 are connected to each other, and a collector of the transistor QP1 is connected to the bases of the transistors QP1, QP2 in common. Emitters of the transistors QP1, QP2 are connected to a power supply voltage Vcc, respectively. The collector of the transistor QP1 is connected to a collector of the transistor QN2 of the input circuit 41. A collector of the transistor QP2 is connected to an emitter of the transistor QP5 of the output circuit 42.

In the other current mirror circuit 46, bases of the transistors QP3, QP4 are connected to each other, and a collector of the transistor QP3 is connected to the bases of the transistors QP3, QP4 in common. Emitters of the transistors QP3, QP4 are connected to a power supply voltage Vcc, respectively. The collector of the transistor QP3 is connected to a collector of the transistor QN3 of the input circuit 41. A collector of the transistor QP4 is connected to an emitter of the transistor QP6 of the output circuit 42.

Here, emitter area ratios of the transistors QP1, QP2; QP3, QP4 are S3:S4, respectively.

The parasitic photocurrent compensating circuits 43, 44 are constituted by transistors QP9, QP10; QP11, QP12 of the same conducting type, respectively. In the embodiment of the invention, the transistors QP9 to QP12 are PNP type transistors.

In the one parasitic photocurrent compensating circuit 43, bases of the transistors QP9, QP10 are connected to each other, and a collector of the transistor QP9 is connected to the bases of the transistors QP9, QP10 in common. Emitters of the transistors QP9, QP10 are connected to a power supply voltage Vcc, respectively. The collector of the transistor QP10 is connected to bases of the transistors QP5, QN5 of the output circuit 42 in common.

In the other parasitic photocurrent compensating circuit 44, bases of the transistors QP11, QP12 are connected to each other, and a collector of the transistor QP11 is connected to the bases of the transistors QP11, QP12 in common. Emitters of the transistors QP11, QP12 are connected to a power supply voltage Vcc, respectively. The collector of the transistor QP12 is connected to bases of the transistors QP6, QN6 of the output circuit 42 in common.

The inversion input buffer circuit 37 is constituted by transistors QP7, QP8, QN7, QN8 of different conducting types from each other and a constant current source F3 which supplies a current I2. In the embodiment of the invention, the transistors QP7, QP8 of one conducting type are PNP type transistors, and the transistors QN7, QN8 of the other conducting type are NPN type transistors.

Bases of the transistors QN7, QN8 are connected to each other, and a collector of the transistor QN8 is connected to bases of the transistors QN7, QN8 in common. Emitters of the transistors QN7, QN8 are connected to the GND, respectively. A collector of the transistor QN7 is connected to a base of the transistor QP7.

The base of the transistor QP7 is connected to the bases of the transistors QP5, QN5 of the output circuit 42. An emitter of the transistor QP7 is connected to the power supply voltage Vcc via the constant current source F3, and connected to the bases of the transistors QN3, QN4 of the input circuit 41 that work as the second input terminal of the transconductance amplifier 36. A collector of the transistor QP7 is connected to an emitter of the transistor QP8. A base of the transistor QP8 is connected to the collector of the transistor QN8. A collector of the transistor QP8 is connected to the GND. The emitter of the transistor QP7 works as an output terminal of the inversion input buffer circuit 37, and becomes an output LPFout of the low pass filter.

Collector currents in2, in3 of the transistors QN2, QN3, which are differential currents, are turned back at the current mirror circuits 45, 46 and inputted to the emitters of the transistors QP5, QP6, respectively, and considering the bases of the transistors QP5, QN5 as current outputs, one end of the capacitor C is connected to the outputs. A voltage vin, which is the input LPFin, is inputted between base terminals of the transistors QN2, QN3, and the currents in2, in3 are outputted in reversed phase from the current mirror circuits 45, 46 to collectors of these transistors QN2, QN3 as collector currents, respectively.

When an emitter area ratio of the transistors QN1, QN2 and an emitter area ratio of the transistors QN4, QN3 are denoted by S1:S2, respectively, and transconductance is gm1, gm1, in2, and in3 are derived, respectively, as shown below:

$$gm1 = \frac{1}{R2} \times \frac{S1}{S1 + S2} \tag{4}$$

$$in2 = vin \times gm1 = vin \times \frac{1}{R2} \times \frac{S1}{S1 + S2} \tag{5}$$

$$in3 = -vin \times gm1 = -vin \times \frac{1}{R2} \times \frac{S1}{S1 + S2} \tag{6}$$

In this case, emitter resistance of the transistors QN2, QN3 is ignored for ease.

Next, currents taken out as the collector currents in2, in3 are turned back as currents ip2, ip3 at the current mirror circuits 45, 46 of the transistors QP1, QP2 and the transistors QP3, QP4, respectively, and inputted to the respective emitters of the transistors QP5, QP6 of the output circuit 42. In the embodiment of the invention, the transistors QP1 to QP4 are PNP type transistors. Although it is possible, by lowering a mirror ratio of the current mirror circuits 45, 46 of the transistors QP1, QP2 and the transistors QP3, QP4, to decrease transconductance gm more, it is assumed here for ease that the mirror ratio is 1:1.

The output of this transconductance amplifier 36 is a node where the base of the transistor QP5 is connected to the base of the transistor QN5. Deriving a base current ip5*b* of the transistor QP5 and a base current in5*b* of the transistor QN5 and finding transconductance gm of the entire transconductance amplifier 36 are expressed as follows. Here, a current amplification rate hfe of a transistor is denoted by bfep in a PNP type transistor and hfen in a NPN type transistor.

At first, the following are expressed:

$$ip5b = ip2 \times \frac{1}{hfep} = in2 \times \frac{1}{hfep} \tag{7}$$

$$\begin{aligned} in5b &= ip3 \times \frac{1}{hfep} \times hfen \times \frac{1}{hfen} \\ &= in3 \times \frac{1}{hfep} \end{aligned} \tag{8}$$

Based on the above expressions 5 to 8, the following are obtained:

$$\begin{aligned} ip5b &= in2 \times \frac{1}{hfep} \\ &= vin \times \frac{1}{R2} \times \frac{S2}{S1+S2} \times \frac{1}{hfep} \end{aligned} \tag{9}$$

$$\begin{aligned} in5b &= in3 \times \frac{1}{hfep} \\ &= -vin \times \frac{1}{R2} \times \frac{S1}{S1+S2} \times \frac{1}{hfep} \end{aligned} \tag{10}$$

Based on the above expressions 9, 10, a current io to the capacitor C is expressed as follows:

$$\begin{aligned} io &= ip5b - in5b \\ &= vin \times \frac{1}{R2} \times \frac{S2}{S1+S2} \times \frac{1}{hfep} \times 2 \end{aligned} \tag{11}$$

Accordingly, the following can be found:

$$gm = \frac{io}{vin} \times \frac{1}{R2} \times \frac{S2}{S1+S2} \times \frac{1}{hfep} \times 2 \tag{12}$$

Here, assuming that, for example, R2=400 kΩ (a practical maximum value of resistance in an integrated circuit), S1:S2=4:1, hfep=50 and C=20 pF, the following is found:

$$gm = \frac{1}{400k\Omega} \times \frac{1}{4+1} \times \frac{1}{50} \times 2 = \frac{1}{50M\Omega} \tag{13}$$

Thus, very high resistance, that is, very low transconductance gm can be generated with ease. For example, a noise removing rate at around 40 kHz of the low pass filter is calculated in the following manner:

$$\begin{aligned} |H_{LPF}(s)| &= \frac{1}{\sqrt{1+\left[\frac{2\pi fC}{gm}\right]^2}} \\ &= \frac{1}{\sqrt{1+\left[\frac{2\pi \times 40\ \text{kHz} \times 20\ \text{pF}}{1/50\ M\Omega}\right]^2}} \approx 0.004 \end{aligned} \tag{14}$$

Then, a noise removing capability becomes approximately −48 dB from the above value of approximately 0.004, and it is possible to sufficiently satisfy a power source noise removing capability which has been required up to now.

Although it is predicted that power source noise directly affects the low pass filter itself from the direct current input power supply voltage Vcc, such noise can be cancelled because the transconductance amplifier 36 has a differential configuration like the transistors QN2, QN3 and has a symmetric structure.

As described above, since the base current io of the transistors QP5, QN5 is used and small enough transconductance gm is produced to implement a low pass filter, it is possible, even when the capacity C is set to a value which allows integration, to obtain a large time constant corresponding to low-frequency signals. Further, a process of an integrated circuit is widespread in general, and it is possible to implement by using a sufficiently low-cost process. Furthermore, since it is possible to implement by tens of circuit elements, it is possible to constitute at low cost.

Figure 5:
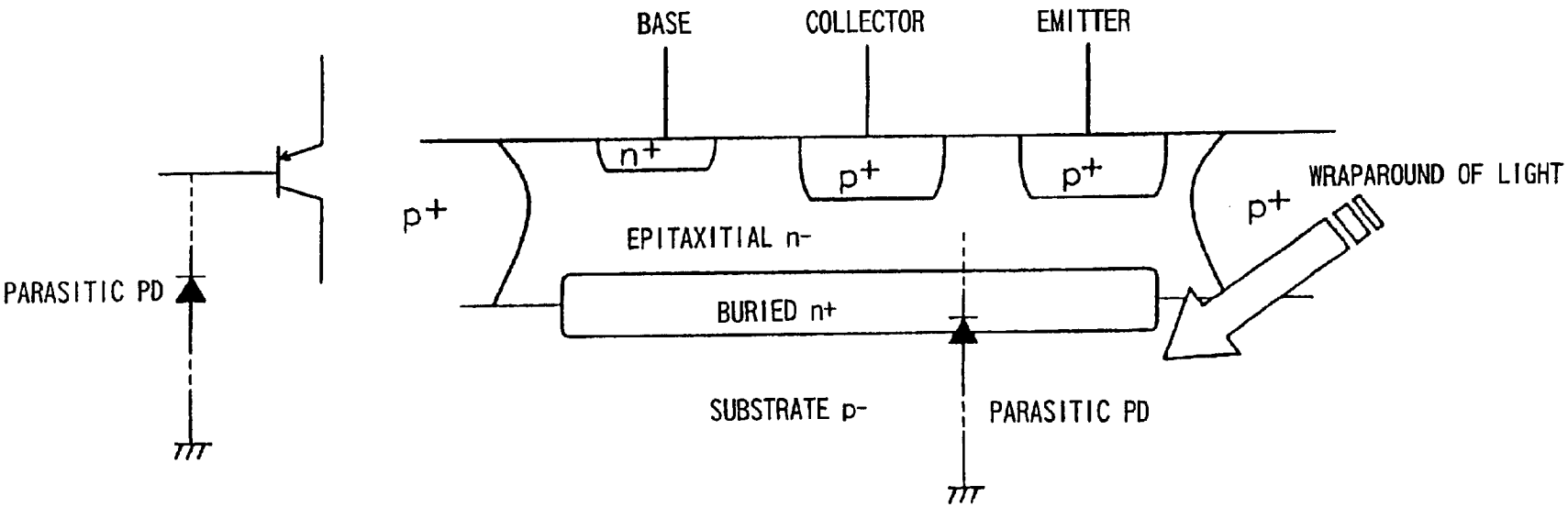
FIG. 5 is a view showing a cross section structure view of a lateral PNP type transistor.

In a device which senses light of an infrared remote control and the like as described before, on the whole, it cannot be avoided that the light enters into or wraps around the device to cause a parasitic photodiode of an integrated circuit to operate. In this case, there is a need to pay attention to a PNP type transistor especially. In a general bipolar integrated circuit, a lateral structure which enables easy production without the use of a special process is often used for a PNP type transistor. However, a lateral PNP type transistor has a structure provided with a parasitic photodiode of a base terminal. A cross section structure view thereof is shown in FIG. 5.

Therefore, in a case where a minute current is used and a lateral PNP type transistor is used in the circuit shown in FIG. 4, the circuit does not operate according to a design value owing to wraparound of light. It should be assumed that, in usual, a few nA of parasitic photocurrent exists at the worst. Accordingly, it is a problem in the case of handling a small current. The invention is configured in such a manner that the input circuit 41 has a differential construction as described before, and therefore, even when a parasitic photocurrent is generated at the base terminals of the transistors QP5, QP6, the parasitic photocurrent is cancelled and transconductance gm does not vary. However, in these parts using transistors, which handle very small base currents, the influence of a parasitic photocurrent is decreased by adding parasitic photocurrent compensating circuits 43, 44 formed by transistors of the same structure.

In other words, in the example of the circuit of FIG. 4, the output circuit 42 of the transconductance amplifier 36 constituted by the transistors QP5, QP6 using lateral PNP type transistors is equipped with the parasitic photocurrent compensating circuits 43, 44 constituted by current mirror circuits by transistors QP9, QP10; QP11, QP12, respectively. It is hereby possible to decrease the influence of the parasitic photocurrent on a minute current.

Figure 6:
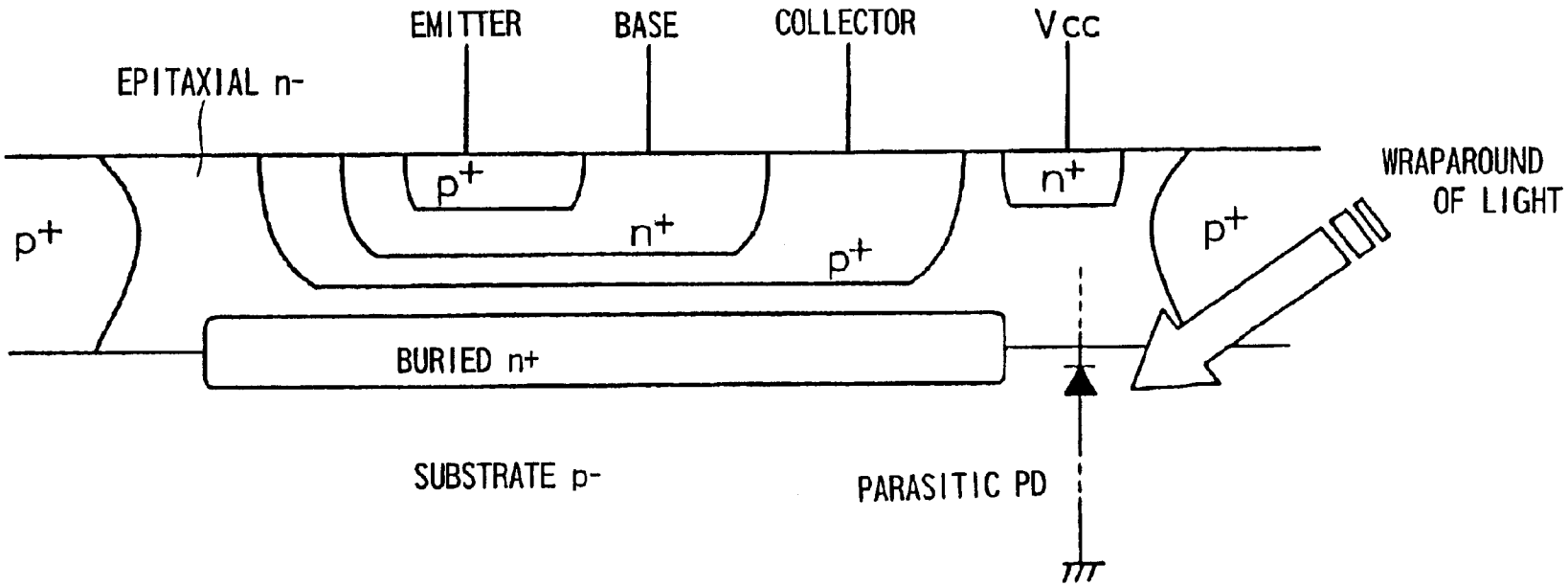
FIG. 6 is a view showing a cross section structure view of a vertical PNP type transistor.

On the other hand, regarding the influence of the parasitic photocurrent, it is also possible by using a vertical PNP type transistor as a PNP type transistor to decrease the parasitic photocurrent itself. In FIG. 6, a cross section structure of a general vertical PNP type transistor is shown.

Although even in this case, a parasitic photocurrent is generated in a parasitic photodiode owing to wraparound of light, a parasitic photodiode of a base terminal is hard to be affected by the wraparound, and a current of a parasitic photodiode which is apt to be affected by the wraparound flows from an epitaxial island to a substrate as shown in FIG. 6, so that there is little influence on the circuit operation. Also in the above manner, the influence of the parasitic photocurrent on a minute current can be decreased.

Another embodiment of the invention will be explained below based on FIGS. 7, 8A, 8B.

Figure 7:
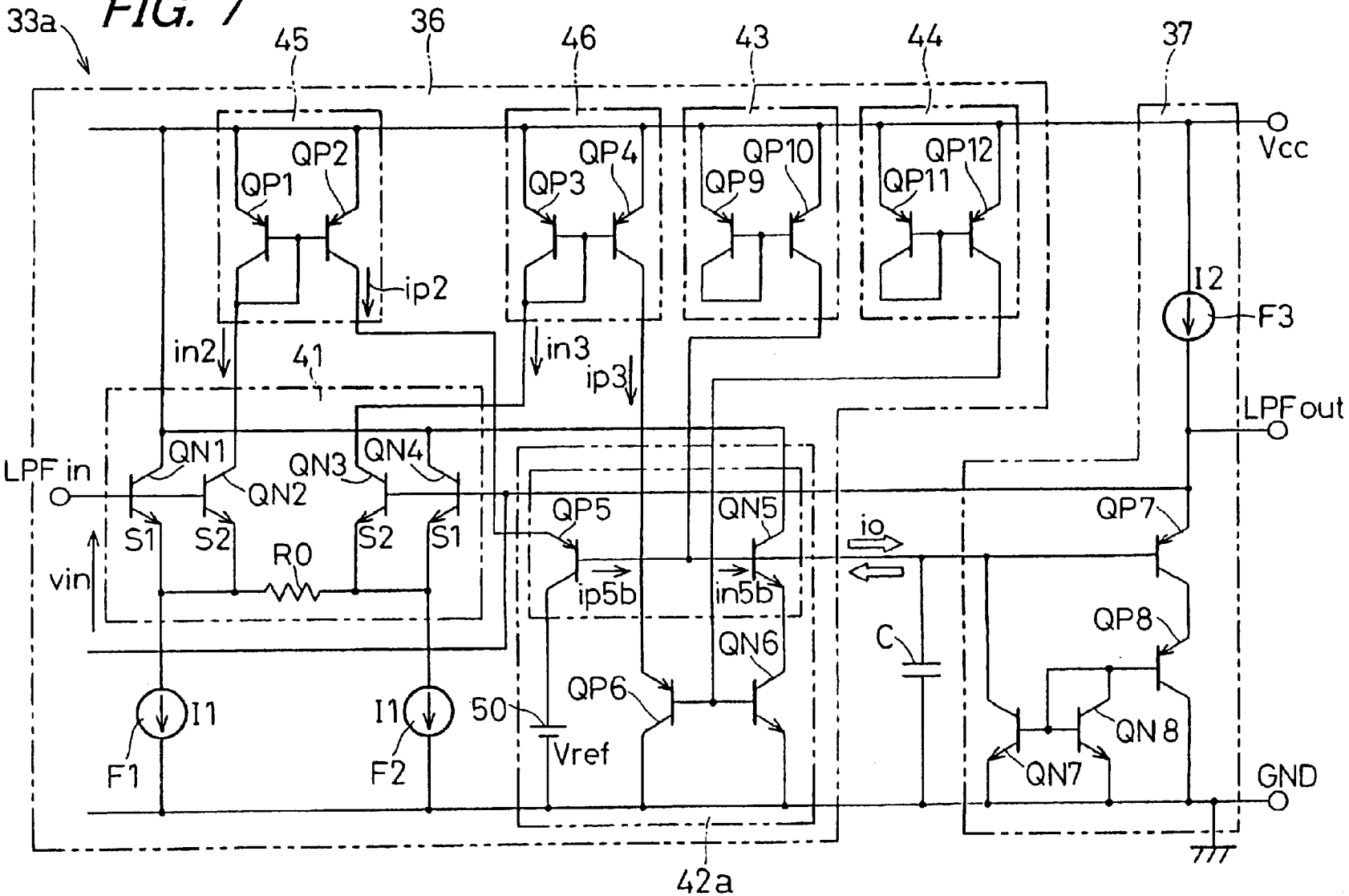
FIG. 7 is an electrical circuit diagram of a power source noise removing circuit in a constant voltage circuit of another embodiment of the invention.

FIG. 7 is an electrical circuit diagram of a power source noise removing circuit 33*a* in a constant voltage circuit of another embodiment of the invention. This power source noise removing circuit 33*a* is similar to the power source noise removing circuit 33 shown in FIG. 4. Corresponding portions are provided with the same reference numerals, and explanations thereof are omitted. It should be noted that within this power source noise removing circuit 33*a*, in an output circuit 42*a* of a transconductance amplifier, a collector of a PNP type transistor QP5 is connected to a GND via a reference voltage source 50.

This is for suppressing that since individual transistors have different collector-emitter voltages Vce, a current difference is caused between transistors, error is caused in the expressions 7 to 10 described before, a direct current voltage of an output LPFout to a differential amplification circuit 34 deviates to cause an offset, and to a direct current level shift voltage of FIG. 1, a relation of Vs=Vcc—Vα deviates to cause performance variation. In other words, to the collector of the transistor QP5, a reference voltage Vref from the reference voltage source 50 is adjusted so that a collector-emitter voltage Vce of the transistor QP5 has a substantially equal value to a value of a collector-emitter voltage Vce of a transistor QP6 with which the collector-emitter voltage Vce of the transistor QP5 is required to be matched. It is hereby possible to suppress an offset of the output LPFout.

Further, although a PNP type transistor is described here because in a PNP type transistor, Early voltage is low and a current amplification rate is apt to be affected by the collector-emitter voltage Vce in general as compared with a NPN type transistor, it is also true of a NPN type transistor.

Figure 8A:
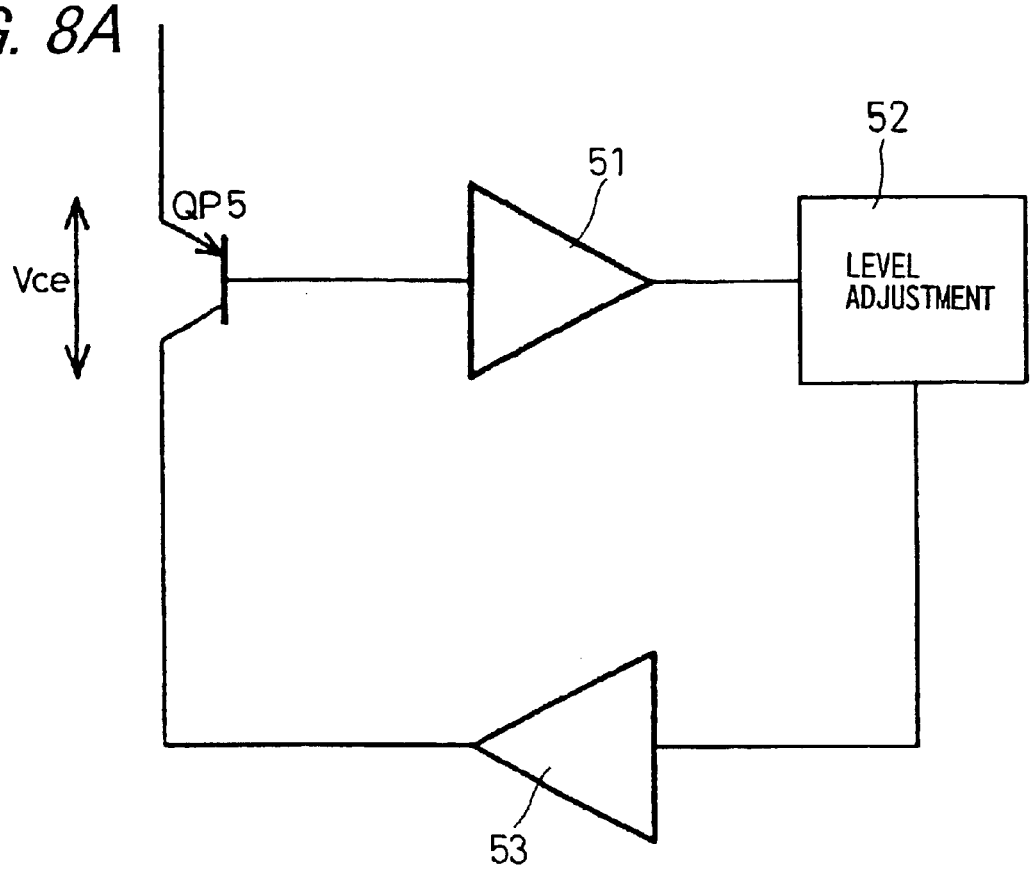
FIGS. 8A, 8B are block diagrams of another example of a configuration of the power source noise removing circuit in the constant voltage circuit of the other embodiment of the invention.

FIG. 8A is a block diagram of a configuration which further reduces the influence of the collector-emitter voltage Vce. In the configuration of FIG. 4, when a direct current level of the power supply voltage Vcc varies, the collector-emitter voltage Vce of the transistor QP6 of the output circuit 42 of the transconductance amplifier is fixed by a base-emitter voltage VBE of the transistor QN6 and a base-emitter voltage VBE of the transistor QP6 to substantially 2VBE, whereas when a direct current voltage of the base of the transistor QP5 varies, imbalance is consequently caused in characteristics of both the transistors QP5, QP6, and the offset voltage is generated.

Referring to FIG. 8A, to the base of the transistor QP5, an input of a first buffer circuit 51 is connected. To an output of the first buffer circuit 51, an input of a level adjusting circuit 52 which shifts a direct current level is connected. Thus, the level adjusting circuit 52 is added to the output of the first buffer circuit 51. To an output of the level adjusting circuit 52, a second buffer circuit 53 is connected. An output of the second buffer circuit 53 is connected to the collector of the transistor QP5.

In the configuration of FIG. 8A, by taking a base voltage of the transistor QP5 into the level adjusting circuit 52 via the first buffer circuit 51, and biasing a collector voltage of the transistor QP5 in the second buffer circuit 53 in response to the base voltage, the collector-emitter voltage Vce of the transistor QP5 is kept to be constant at all times. Consequently, the collector-emitter voltage Vce of the transistor QP5 becomes a fixed voltage regardless of variation of the power supply voltage Vcc, with the result that it is possible to operate with little influence of Early effect.

Figure 8B:
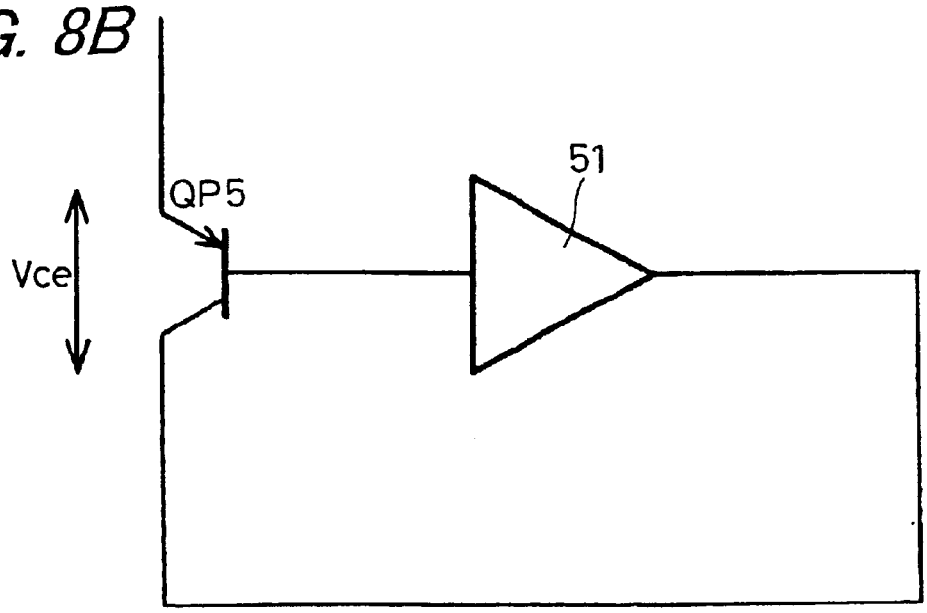

Further, although the influence of the collector-emitter voltage Vce is improved more by the configuration shown in FIG. 8A in the embodiment of the invention, a configuration shown in FIG. 8B may be used instead thereof. In other words, referring to FIG. 8B, to the base of the transistor QP5, the input of the first buffer circuit 51 is connected. The output of the first buffer circuit 51 is connected to the collector of the aforementioned transistor. Also in this configuration, it is possible to obtain the same effect as in the configuration shown in FIG. 8A.

Figure 9:
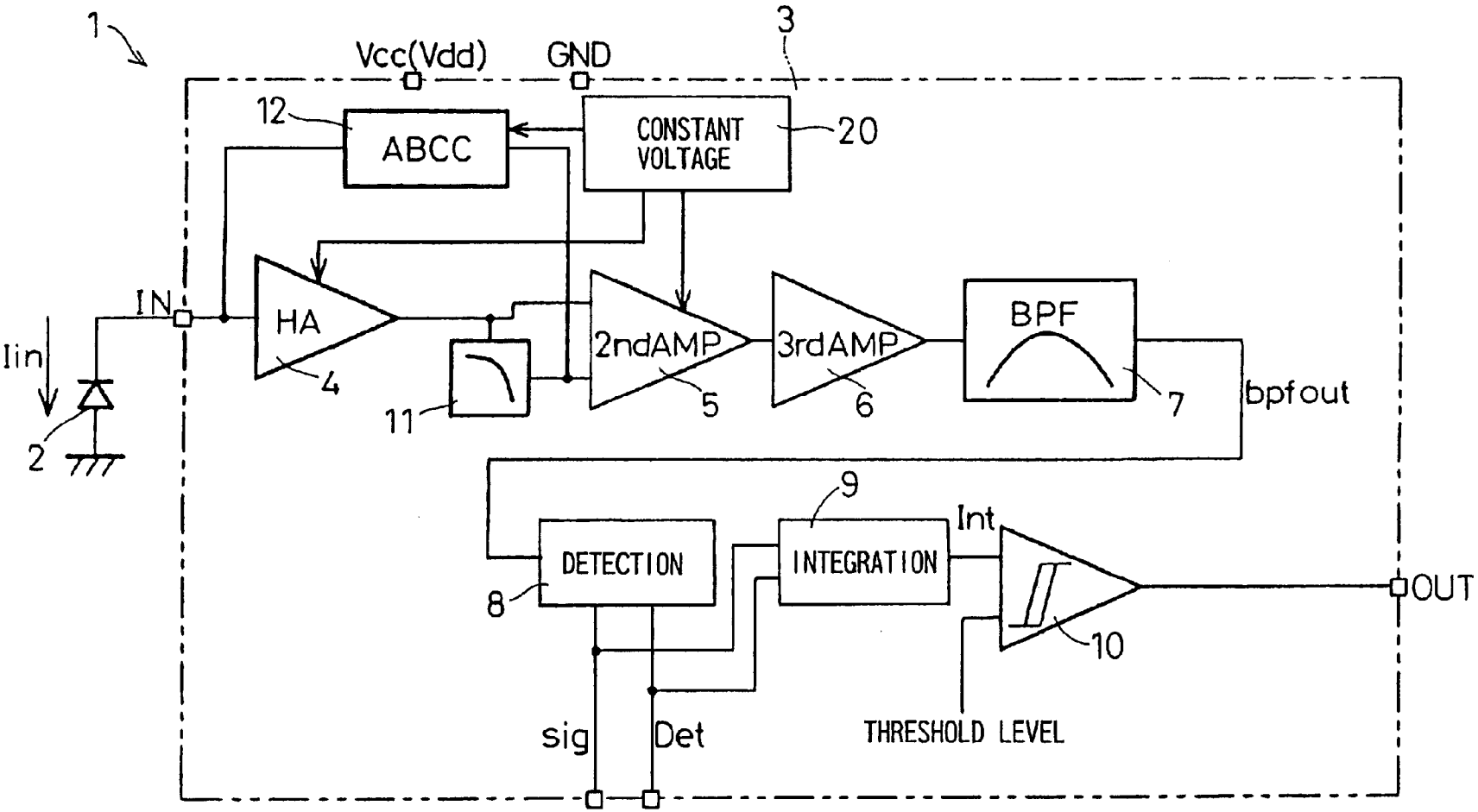
FIG. 9 PRIOR ART
FIG. 9 is a block diagram entirely showing an example of a reception system of an infrared remote control receiver.
Figure 10A:
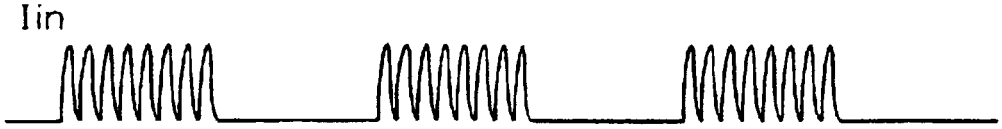
FIG. 10A PRIOR ART
FIGS. 10A to 10D are waveform views of individual portions of the receiver of FIG. 9.
Figure 10B:
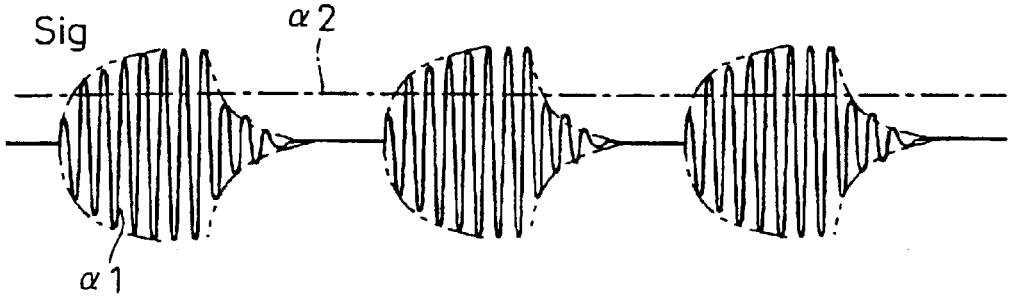
FIG. 10B PRIOR ART
Figure 10C:
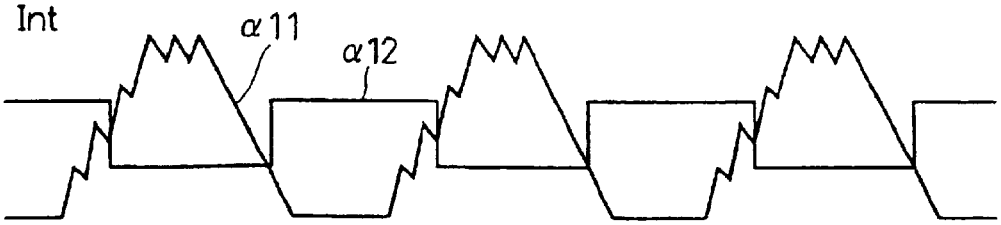
FIG. 10C PRIOR ART
Figure 10D:
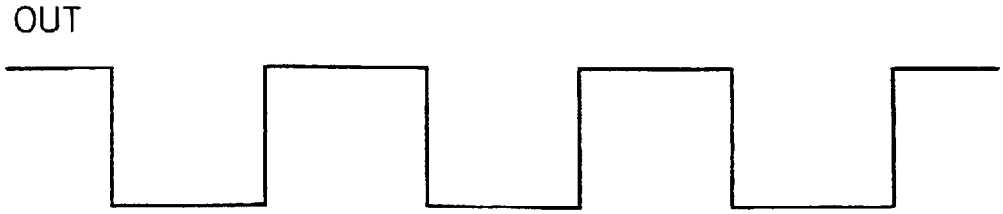
FIG. 10D PRIOR ART
Figure 11:
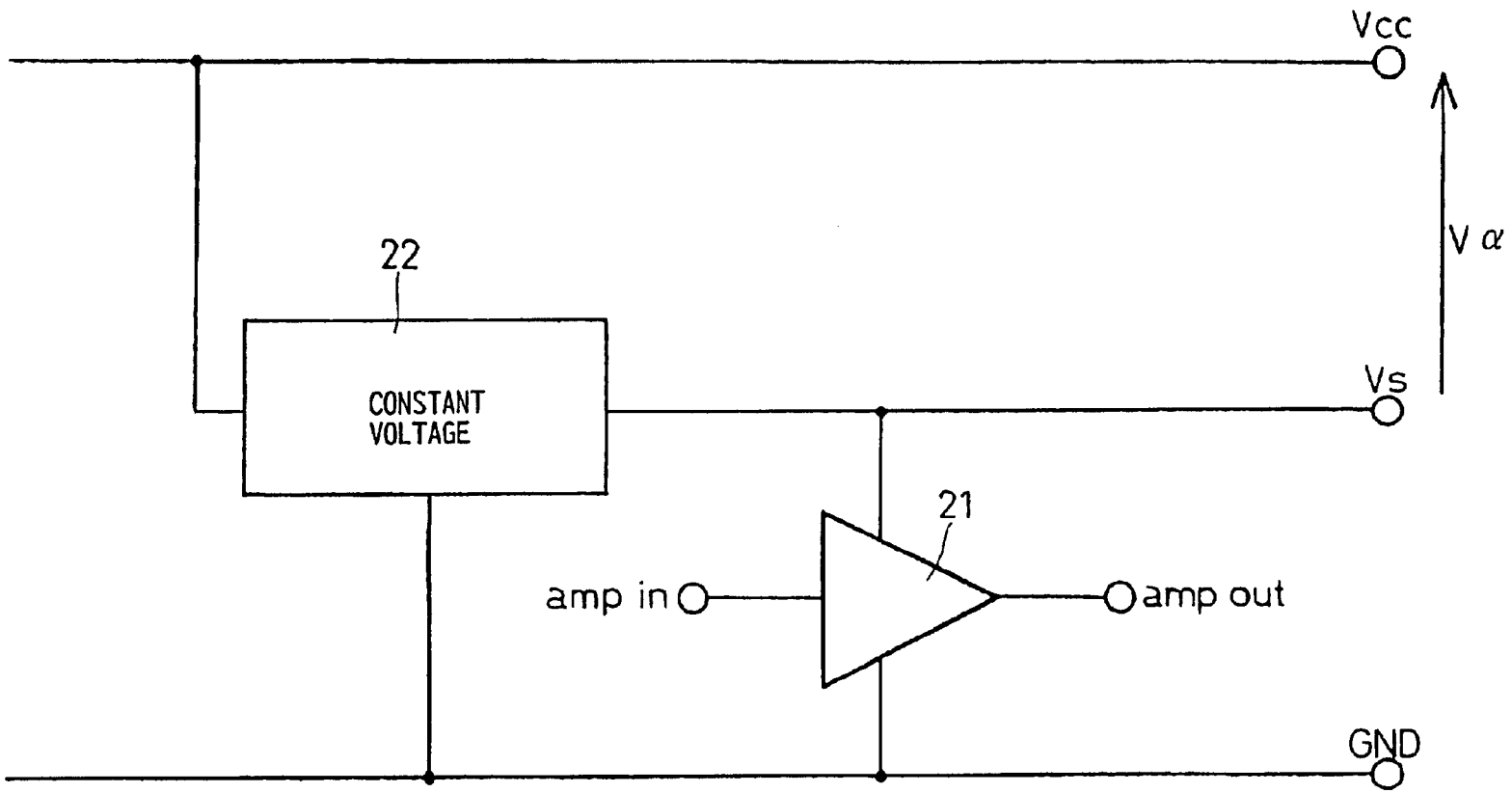
FIG. 11 PRIOR ART
FIG. 11 is a view for explaining countermeasures against power source noise in a typical prior art.
Figure 12:
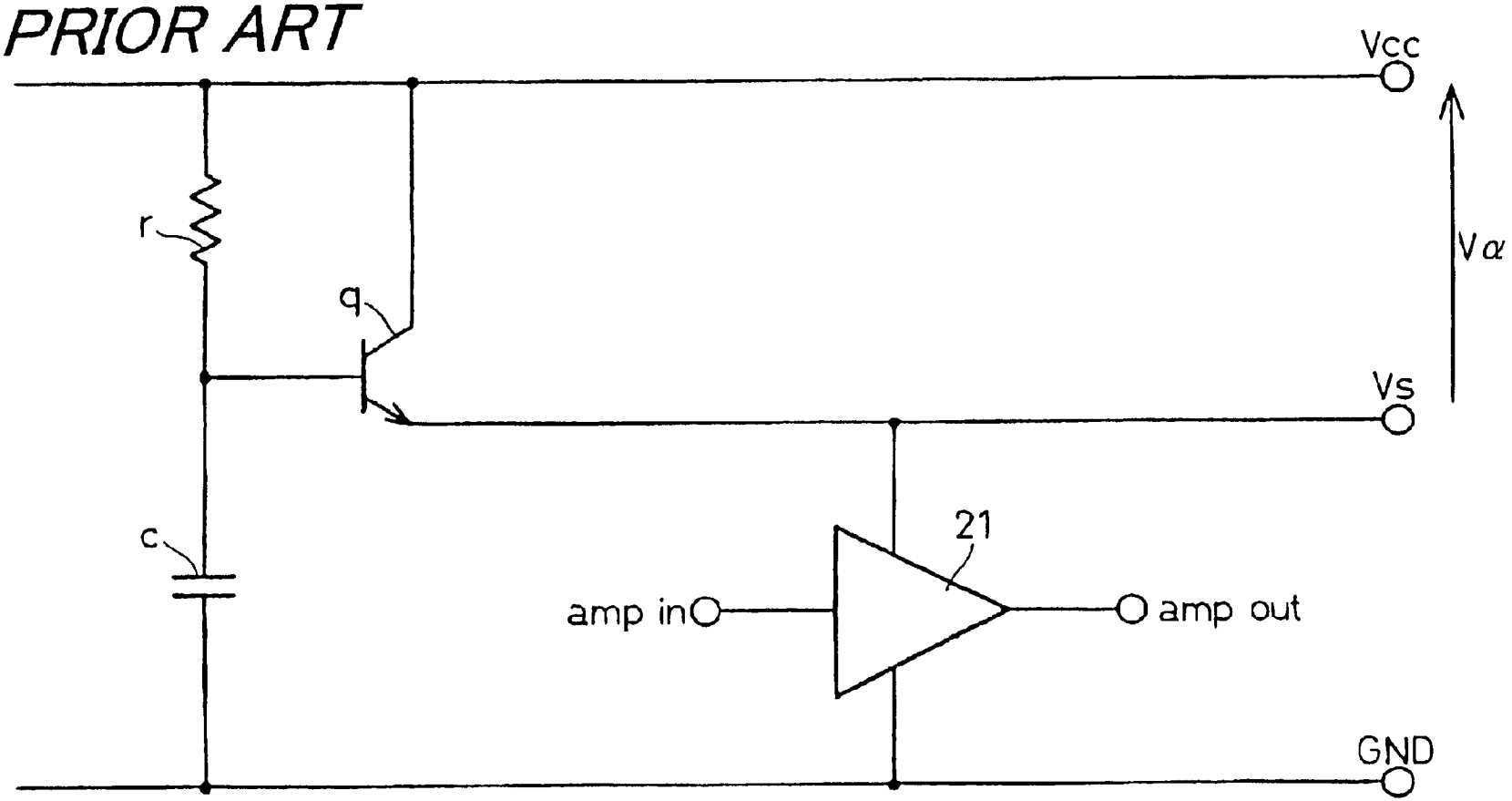
FIG. 12 PRIOR ART
FIG. 12 is a view for explaining countermeasures against power source noise in another prior art.

Still further, by using the constant voltage circuits of the embodiments of the invention shown in FIGS. 1 to 8B in place of the constant voltage circuit 20 used in the infrared remote control receiver 1 shown in FIG. 9, it is possible to implement an infrared remote control receiver which is hard to be affected by power source noise.

Although a bipolar transistor is used as a transistor constituting the power source noise removing circuit 33 in the embodiments of the invention, a field effect transistor (FET) may be used instead thereof. Moreover, the field effect transistor may be either a junction field effect transistor or a MOS type field effect transistor (MOS FET). In the case of using the field effect transistor, in the description regarding the power source noise removing circuit 33 in this specification, the PNP type transistor may be considered as a p channel type FET, the NPN type transistor may be considered as a n channel type FET, and the base, collector and emitter are considered as a gate, drain and source, respectively. Also in this configuration, it is possible to obtain the same effect as in the embodiments of the invention.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and the range of equivalency of the claims are therefore intended to be embraced therein.

What is claimed is:

1. A constant voltage circuit which removes power source noise by outputting a direct current constant voltage responsive to a direct current input power supply voltage, the constant voltage circuit comprising:

a direct current level shift circuit for effecting a shift from the input power supply voltage by a predetermined direct current voltage level;

a power source noise removing circuit including a transconductance amplifier, for removing the power source noise from an output of the direct current level shift circuit; and a PNP type transistor interposed in series with a power supply line between input and output terminals, a base of the PNP type transistor being driven by an output from the power source noise removing circuit.

2. The constant voltage circuit of claim 1, wherein a level shift amount in the direct current level shift circuit is set to around a collector-emitter saturation voltage of the PNP type transistor.

3. The constant voltage circuit of claim 1, wherein an input circuit of the transconductance amplifier constituting the power source noise removing circuit is provided with first to fourth transistors of a same conducting type and a resistor;

bases or gates of the first and second transistors are connected to each other to become a first input terminal of the transconductance amplifier, and emitters or sources of the first and second transistors are connected to a first constant current source in common;

bases or gates of the third and fourth transistors are connected to each other to become a second input terminal of the transconductance amplifier, and emitters or sources of the third and fourth transistors are connected to a second constant current source in common;

the emitters or sources of the first and second transistors are connected to the emitters or sources of the third and fourth transistors via the resistor; and collectors or drains of the first and fourth transistors are connected to a power source terminal.

4. The constant voltage circuit of claim 1, wherein an output circuit of the transconductance amplifier constituting the power source noise removing circuit is provided with fifth and sixth transistors of different conducting types from each other;

a base or gate of the fifth transistor is connected to a base or gate of the sixth transistor; and a capacity of the transconductance amplifier is charged and discharged by a base or gate current.

5. The constant voltage circuit of claim 4, wherein the output circuit of the transconductance amplifier constituting the power source noise removing circuit is further provided with, in correspondence with the fifth and sixth transistors, seventh and eighth transistors of different conducting types from each other;

the fifth transistor of one conducting type is paired with the sixth transistor of the other conducting type, and the seventh transistor of one conducting type is paired with the eighth transistor of another conducting type;

a base or gate of the seventh transistor is connected to a base or gate of the eighth transistor, collectors or drains of the fifth and seventh transistors are connected to a ground (GND) or a power source in common, a collector or drain of the sixth transistor is connected to the power source or the GND, an emitter or source of the sixth transistor is connected to a collector or drain of the eighth transistor, and an emitter or source of the eighth transistor is connected to the GND or the power source; and a differential current is inputted from the input circuit to emitters or sources of the fifth and seventh transistors.

6. The constant voltage circuit of claim 5, wherein of the fifth to eighth transistors, transistors which use a minute base or gate current are PNP type transistors, which transistors are formed so as to be of a lateral structure, and with respect to the PNP type transistors, a parasitic photocurrent compensating circuit is disposed.

7. The constant voltage circuit of claim 5, wherein of the fifth to eighth transistors, transistors which use a minute base or gate current are PNP type transistors, which PNP type transistors are formed so as to be of a vertical structure.

8. The constant voltage circuit of claim 5, wherein a voltage is supplied to the collector of at least one of the fifth and seventh transistors, and collector-emitter voltages of the transistors are set to a substantially equal value.

9. The constant voltage circuit of claim 5, wherein an input of a first buffer circuit is connected to the base or gate of at least one of the fifth and seventh transistor, and an output of the buffer circuit is connected to the collector or drain of the aforementioned transistor.

10. The constant voltage circuit of claim 5, wherein an input of a first buffer circuit is connected to the base or gate of at least one of the fifth and seventh transistors, a level adjusting circuit which shifts a direct current level is added to an output of the first buffer circuit, an input of a second buffer circuit is connected to an output of the level adjusting circuit, and an output of the second buffer circuit is connected to the collector or drain of at least one of the fifth and seventh transistors.

11. An infrared remote control receiver comprising the constant voltage circuit of claim 1.

* * * * *